US010281137B2

(12) United States Patent
Tsai et al.

(10) Patent No.: US 10,281,137 B2
(45) Date of Patent: May 7, 2019

(54) VENTILATING AND ILLUMINATING APPARATUS

(71) Applicant: DELTA ELECTRONICS, INC., Taoyuan (TW)

(72) Inventors: Chia-Yu Tsai, Taoyuan (TW); Wen-Hsiang Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 246 days.

(21) Appl. No.: 15/272,860

(22) Filed: Sep. 22, 2016

(65) Prior Publication Data

US 2018/0080645 A1 Mar. 22, 2018

(51) Int. Cl.

| | |
|---|---|
| ***F21V 33/00*** | (2006.01) |
| ***F21V 31/00*** | (2006.01) |
| ***F24F 7/007*** | (2006.01) |
| *F21S 8/04* | (2006.01) |
| *F21V 17/12* | (2006.01) |
| *F21V 1/14* | (2006.01) |
| *F24F 3/056* | (2006.01) |

(52) U.S. Cl.

CPC ..... *F21V 33/0096* (2013.01); *F21V 31/005* (2013.01); *F24F 7/007* (2013.01); *F21S 8/04* (2013.01); *F21V 1/146* (2013.01); *F21V 17/12* (2013.01); *F24F 3/056* (2013.01)

(58) Field of Classification Search

None

See application file for complete search history.

(56) References Cited

U.S. PATENT DOCUMENTS

| | | | | |
|---|---|---|---|---|
| 2,861,121 | A * | 11/1958 | Isidore | F21S 8/06 174/54 |
| 2,867,404 | A * | 1/1959 | Ramsing | F21S 8/06 248/324 |
| 6,682,036 | B1 * | 1/2004 | Hsu | F21S 8/04 248/342 |
| D681,249 | S * | 4/2013 | Tom | D23/411 |
| 9,022,846 | B1 * | 5/2015 | Tom | F24F 7/007 454/338 |
| 9,175,874 | B1 * | 11/2015 | Tom | F04D 19/00 |
| 9,416,989 | B1 * | 8/2016 | Tom | F24F 13/078 |
| 10,012,374 | B2 * | 7/2018 | Zhou | F21V 25/00 |
| 2004/0095752 | A1 * | 5/2004 | Hsu | F21S 8/04 362/147 |
| 2005/0111840 | A1 * | 5/2005 | Craw | F24H 3/0411 392/350 |

(Continued)

*Primary Examiner* — Elmito Breval

(74) *Attorney, Agent, or Firm* — Kirton McConkie; Evan R. Witt

(57) ABSTRACT

The present invention provides a ventilating and illuminating apparatus. The ventilating and illuminating apparatus includes a ventilating fan, a connecting frame, an illuminating device and a connecting shaft. The ventilating fan has a housing. The connecting frame is connected to the housing and has a mounting portion and a fastening hole. The fastening hole is disposed on the mounting portion. The illuminating device has an illuminating element and a through hole. The connecting shaft partially passes through the through hole of the illuminating device and the fastening hole of the connecting frame and is mounted on the mounting portion of the connecting frame, so as to fasten the illuminating device on the mounting portion of the connecting frame.

19 Claims, 8 Drawing Sheets

(56) References Cited

U.S. PATENT DOCUMENTS

| | | | | |
|---|---|---|---|---|
| 2007/0183138 | A1* | 8/2007 | Cooper | F21V 21/03<br>362/147 |
| 2015/0276197 | A1* | 10/2015 | Horng | F21V 29/60<br>362/294 |

* cited by examiner

VENTILATING AND ILLUMINATING APPARATUS

FIELD OF THE INVENTION

The present invention relates to a ventilating and illuminating apparatus, and more particularly to a ventilating and illuminating apparatus having a detachable illuminating device.

BACKGROUND OF THE INVENTION

With the increasing requests of indoor environmental quality (IEQ), ventilating fans are usually provided and installed into the ceiling. Furthermore, illustrating devices are usually installed on the ceiling. For saving the installation space, a conventional ventilating and illuminating apparatus can combine elements of a conventional ventilating fan with an illuminating device for controlling the indoor air quality and providing quiescent light at the same time. After combining the conventional ventilating fan and the conventional illustrating device simply, the conventional ventilating and illuminating apparatus generally has a bulky, unaesthetic appearance and employ a complicated design for integrating the ventilating and illuminating functions. Furthermore, the combined apparatus seems difficult to install, maintain or replace the illuminating device without disassembling the relative ventilating fan.

On the other hand, in the conventional ventilating and illuminating apparatus, the ventilating fan is mainly used to control indoor air quality by diluting and displacing indoor pollutants and used for purposes of thermal comfort or dehumidification. When the components of the ventilating and illuminating apparatus can fail to be arranged efficiently, the ventilating fan can fail to cool the lighting device, and the illuminating device combined with the ventilating fan can be employed at high temperature and high humidity. In the above operating condition, it is easy to damage the illuminating device. Furthermore, comparing with the ventilating fan, the illuminating device need spare parts and maintenance. However, it always takes a lot of time to maintain or replace the illuminating device from the entire ventilating and illuminating apparatus.

Therefore, there is a need of providing a ventilating and illuminating apparatus having a detachable illuminating device to overcome the above drawbacks.

SUMMARY OF THE INVENTION

The present invention provides a ventilating and illuminating apparatus having a detachable illuminating device. The detachable illuminating device is fastened by several modular parts, so as to reduce installation time and materials of the entire structure and facilitate to execute regular maintenance of detachable illuminating device.

The present invention further provides a ventilating and illuminating apparatus having a detachable illuminating device, wherein the detachable illuminating device is capable of maintenance and replacing easily, and further provides waterproof lighting for avoiding from the influence of humidity caused by ventilating air.

The present invention further provides a ventilating and illuminating apparatus having modular parts for increasing the variation and facilitating to install and replace.

In accordance with an aspect of the present invention, there is provided a ventilating and illuminating apparatus including a ventilating fan, a connecting frame, an illuminating device and a connecting shaft. The ventilating fan has a housing. The connecting frame is connected to the housing and has a mounting portion and a fastening hole. The fastening hole is disposed on the mounting portion. The illuminating device has an illuminating element and a through hole. The connecting shaft partially passes through the through hole of the illuminating device and the fastening hole of the connecting frame and is mounted on the mounting portion of the connecting frame, so as to fasten the illuminating device on the mounting portion of the connecting frame.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
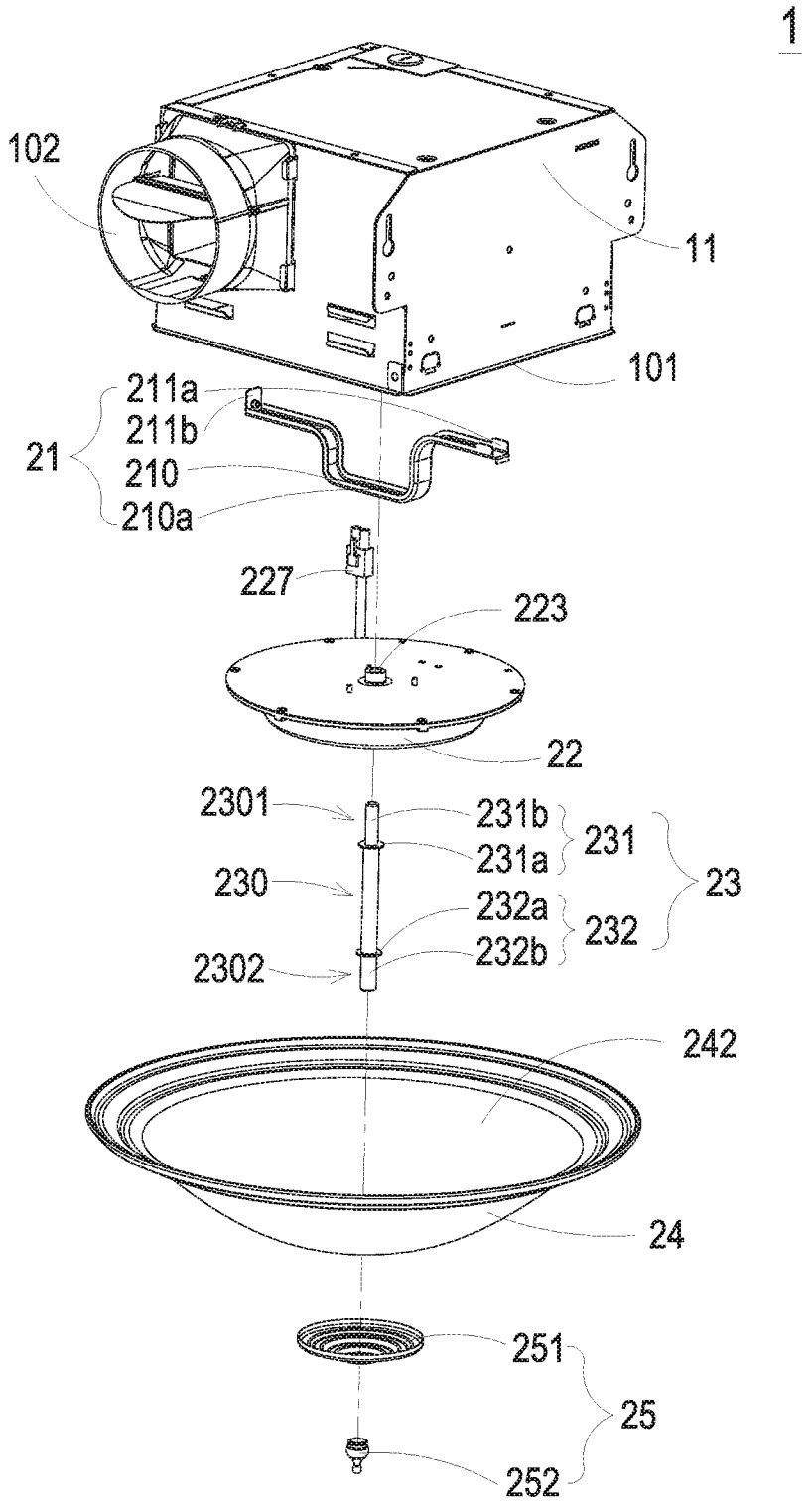
FIG. 1 is an exploded view illustrating a ventilating and illuminating apparatus according to a first preferred embodiment of the present invention.
Figure 2:
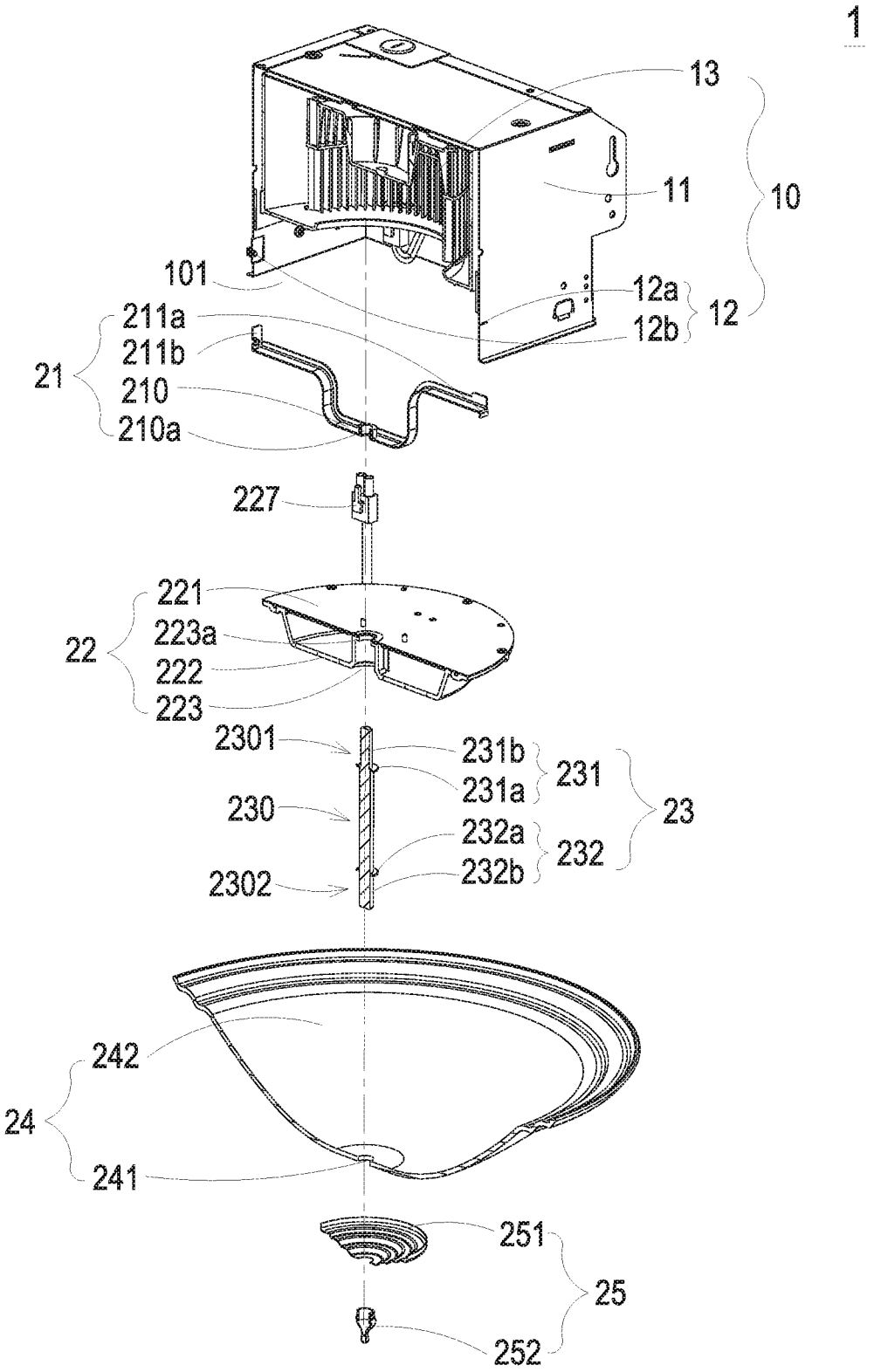
FIG. 2 is a sectional view of FIG. 1.

FIG. 1 is an exploded view illustrating a ventilating and illuminating apparatus according to a first preferred embodiment of the present invention. FIG. 2 is a sectional view of FIG. 1. As shown in FIGS. 1 and 2, the ventilating and illuminating apparatus 1 includes a ventilating fan 10, a connecting frame 21, an illuminating device 22, a connecting shaft 23, a lampshade 24, and a fixing element 25.

The ventilating fan 10 includes a housing 11, an inhaling opening 101, an exhausting opening 102 and a fan wheel 13, wherein the fan wheel 13 is rotated to create a flow of air from the inhaling opening 101 and out of the exhausting opening 102. In the embodiment, the ventilating fan 10 is an embedded ventilating fan and the housing 11 is fastened and embedded into an object, such as a ceiling (not shown).

The connecting frame 21 is disposed nearby the inhaling opening 101. The connecting frame 21 includes two fastening ends 211*a*, 211*b*, a mounting portion 210 and a fastening hole 210*a*. The fastening hole 210*a* is disposed on the mounting portion 210. In the embodiment, the connecting frame 21 is connected to the housing 11 by the two fastening ends 211*a*, 211*b*. Namely, the two fastening ends 211*a*, 211*b* are configured to fasten the connecting frame 21 on the housing 11 and the mounting portion 210 of the connecting frame 21 extends outwardly from the inhaling opening 101. Simultaneously, the housing 11 includes a fastened element 12 to connect with the connecting frame 21. In the embodiment, the fastened element 12 has two fastened portions 12*a*, 12*b* configured to connect with the two corresponding fastening ends 211*a*, 211*b* respectively so as to fasten the connecting frame 21 on the housing 11 and have the connecting frame 21 stretching across the inhaling opening 101 of the housing 11. Namely, the connecting frame 21 extends outwardly form the inhaling opening 101 and the mounting portion 210 of the connecting frame 21 is located outside the housing 11. In the embodiment, two fastening ends 211*a*, 211*b* are a hook and a screw hole respectively. Correspondingly, the two fastened portions 12*a*, 12*b* are an engaged hole and a screw hole. For fastening the connecting frame 21 on the housing 11, the fastening end 211*a* of the connecting frame 21 is disposed into and engaged with the fastened portion 12*a* of the housing 11 firstly, and then the fastening end 211*b* of the connecting frame 21 and the fastened portion 12*b* are engaged with each other via a screw (not shown). Consequently, the two fastening ends 211*a*, 211*b* are engaged with the two fastened portions 12*a*, 12*b* respectively and the connecting frame 21 is fastened on the housing 11 and stretching across the inhaling opening 101 of the housing 11. In other embodiments, the two fastening ends 211*a*, 211*b* can be respectively selected from but not limited to a hook, a buckle, a clamp and a screw. The two fastened portions 12*a*, 12*b* can be respectively selected from but not limited to an engaged hole and a screw hole.

Figure 3B:
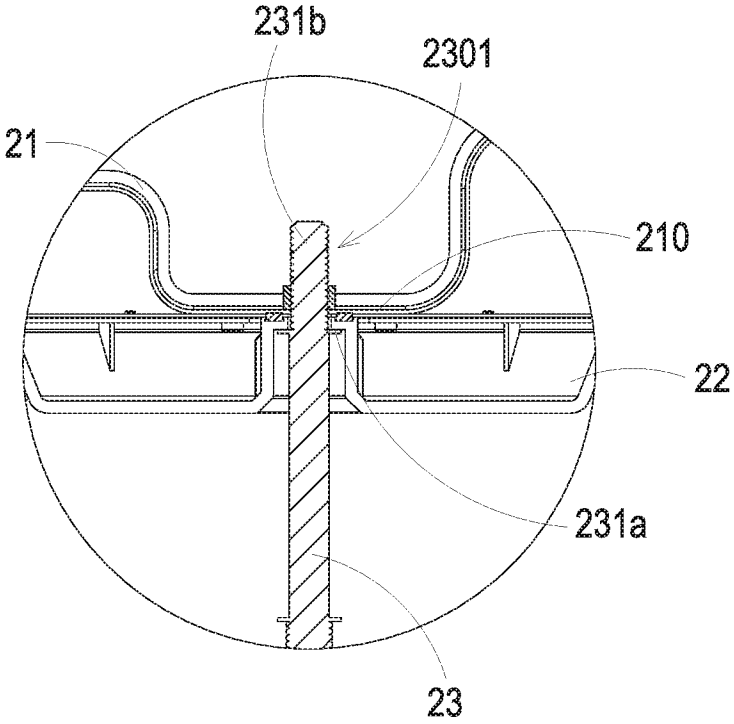
FIGS. 3A and 3B are partial enlargement views illustrating the connecting relationship of the connecting frame before assembling and after assembling.
Figure 3A:
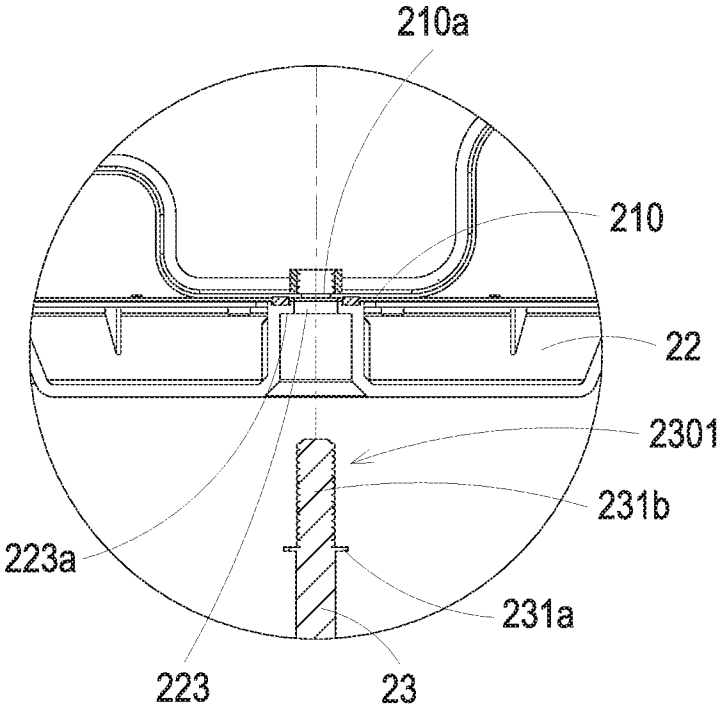

FIGS. 3A and 3B are partial enlargement views illustrating the connecting relationship of the connecting frame, the illuminating device and the connecting shaft. FIG. 3A illustrates the relationship before assembling and FIG. 3B illustrates the relationship after assembling. In the embodiment, the illuminating device 22 includes a through hole 223. The connecting shaft 23 includes a main portion 230, a first end 2301, and a second end 2302. The first end 2301 is connected to the main portion 230 and configured to pass through the through hole 233 of the illuminating device 22 and the fastening hole 210*a* of the connecting frame 21 so as to fasten the illuminating device 22 on the mounting portion 210 of the connecting frame 21. The connecting shaft 23 includes a first fastening element 231 disposed on the first end 2301 and the first fastening element 231 is further divided into a first clamping portion 231*a* and a screwing portion 231*b*. The first clamping portion 231*a* is disposed between the first end 2301 and the main portion 230 and extends outwardly from the outer circumferential surface of the main portion 230, so that the outer circumferential surface of the first clamping portion 231*a* is larger than the outer circumferential surface of the main portion 230 of the connecting shaft 23. The first screwing portion 231*b* is disposed on the first end 2301 and extended sequentially from the main portion 230 to the first end 2301. For fastening the illuminating device 22 on the mounting portion 210 of the connecting frame 21, the first screwing portion 231*b* of the fastening element 231 passes through the through hole 223 of the illuminating device 22 and is engaged with the fastening hole 210*a* of the connecting frame 21, and the first clamping portion 231 is configured to clamp and fasten the illuminating device 22 between the connecting shaft 23 and the connecting frame 21. In the embodiment, the illuminating device 22 further includes a resisting portion 223*a* disposed around the through hole 223 and configured to push against the first clamping portion 231*a* while the first screwing portion 231*b* of the connecting shaft 23 passes through the through hole 223 of the illuminating device 22 and the fastening hole 210*a* of the connecting frame 21, so as to fix the illuminating device 22 firmly.

The lampshade 24 includes a receiving space 242 and a clamping hole 241. Correspondingly, the connecting shaft 23 further includes a second fastening element 232 disposed on the second end 2302 and configured to fasten the lampshade 24. The ventilating and illuminating apparatus 1 further includes a fixing element 25 configured to engage with the second fastening element 232 while the second end 2302 of the connecting shaft 23 passes through the clamping hole 241 of the lampshade 24 so that the lampshade 24 is clamped and fastened on the connecting shaft 23 and the illuminating device 22 is accommodated in the receiving space 242 of the lampshade 24.

Figure 4B:
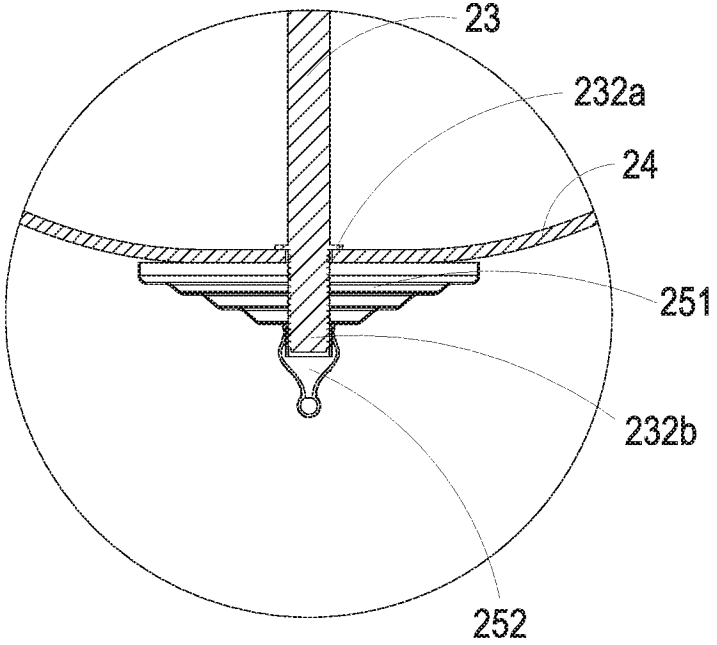
FIGS. 4A and 4B are partial enlargement views illustrating the connecting relationship of the connecting shaft, the lampshade and the fixing element before assembling and after assembling.
Figure 4A:
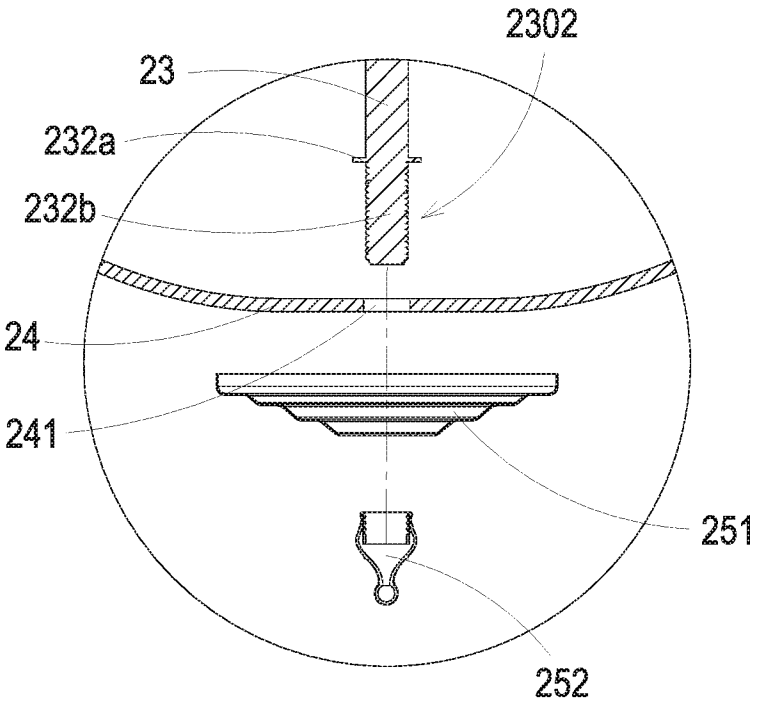

FIGS. 4A and 4B are partial enlargement views illustrating the connecting relationship of the connecting shaft, the lampshade and the fixing element. FIG. 4A illustrates the relationship before assembling and FIG. 4B illustrates the relationship after assembling. In the embodiment, the second fastening element 232 includes a second clamping portion 232*a* and a screwing portion 232*b*. The second clamping portion 232*a* is disposed between the second end 2302 and the main portion 230 and extends outwardly from the outer circumferential surface of the main portion 210, so that the outer circumferential surface of the second clamping portion 232*a* is larger than the outer circumferential surface of the main portion 230 of the connecting shaft 23. The second screwing portion 232*b* is disposed on the second end 2302 and extended sequentially from the main portion 230 to the second end 2302. It is noted that the outer circumferential surface of the second clamping portion 232*a* is larger than the size of the clamping hole 241 of the lampshade 24, and the outer circumferential surface of the second screwing portion 232*b* is smaller than the size of the clamping hole 241 of the lampshade 24, but the present invention is not limited thereto. In the embodiment, the fixing element 25 can include but not limited to a clamping ring 251 and an engaged part 252. Consequently, the lampshade 24 is clamped between the second clamping portion 232*a* of the connecting shaft 23 and the clamping ring 251. The engaged part 252 is engaged with the second screwing portion 232*b* of the connecting shaft 23 while the second screwing portion 232*b* of the connecting shaft 23 passes through the clamping hole 241 of the lampshade 24 so as to clamp and fasten the lampshade 24 on the second end 2302 of the connecting shaft 23.

Figure 5:
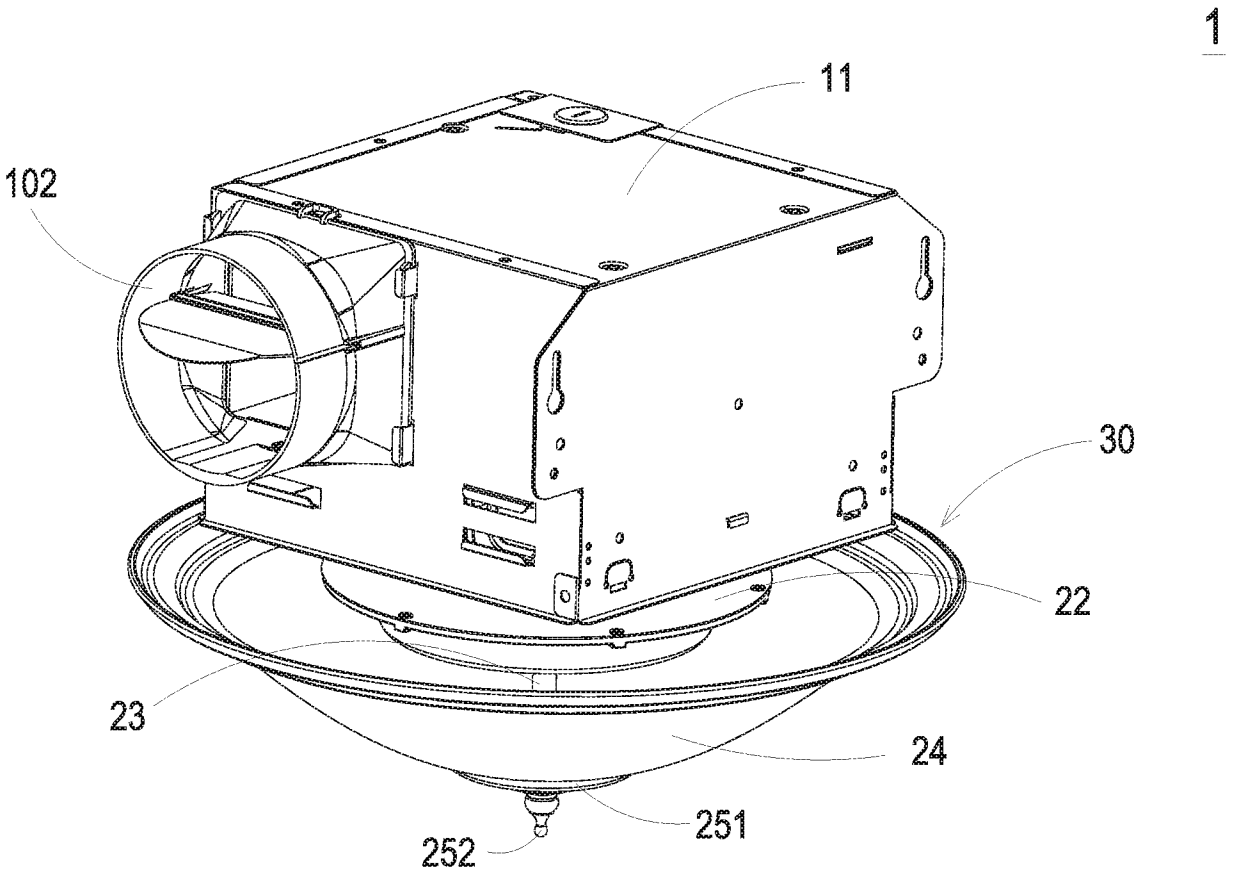
FIG. 5 is a perspective view illustrating a ventilating and illuminating apparatus after assembling.
Figure 6:
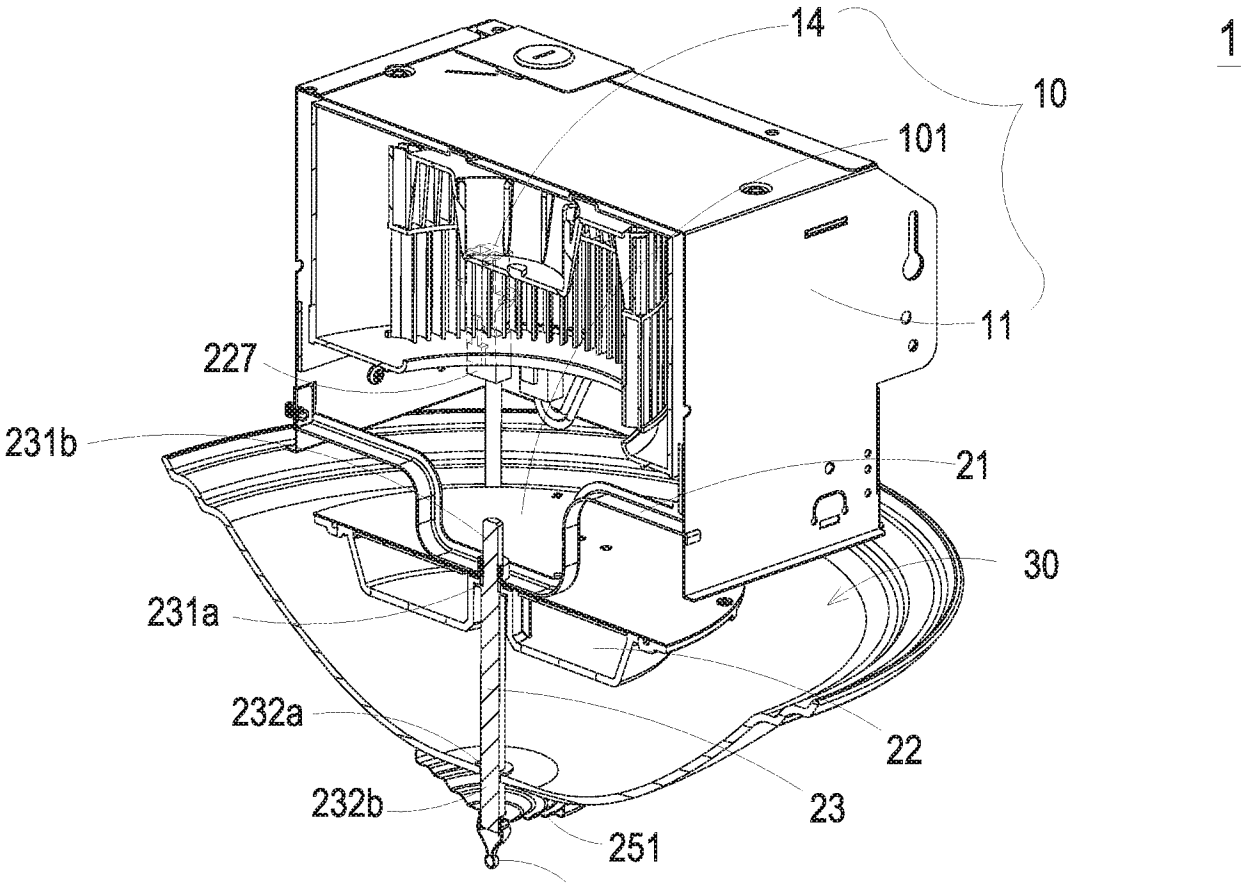
FIG. 6 is a sectional view of FIG. 5.

FIG. 5 is a perspective view illustrating a ventilating and illuminating apparatus after assembling. FIG. 6 is a sectional view of FIG. 5. In the embodiment, the illuminating device 22 is detachable from the ventilating and illuminating apparatus. After assembling according to the above description, the illuminating device 22 is fastened nearby the inhaling opening 101 by the connecting frame 21 and the connecting shaft 23. The lampshade 24 is further fastened under the illuminating device 22 and receives the illuminating device 22 in the receiving space 242 thereof. In some embodiments, the dispatching location of the illuminating device 22 is adjustable by means of adjusting the dispatching location of the mounting portion 210 relative to the connecting frame 21 or the housing 11. On the other hand, the dispatching location of the lampshade 24 is adjustable by means of adjusting the length of the main portion 210. Namely, the connecting frame 21 and the connecting shaft 23 are detachable and replaceable, but the present invention is not limited thereto. It is not redundantly described herein. It is noted that the housing 11 and the illuminating device 22 are configured to form an air channel 30 connected to the inhaling opening 101. Consequently, when the ventilating fan 10 is working, the air is sequentially inhaled from the air channel 30 and the inhaling opening 101 and then exhausted from the exhausting opening 102.

Figure 7:
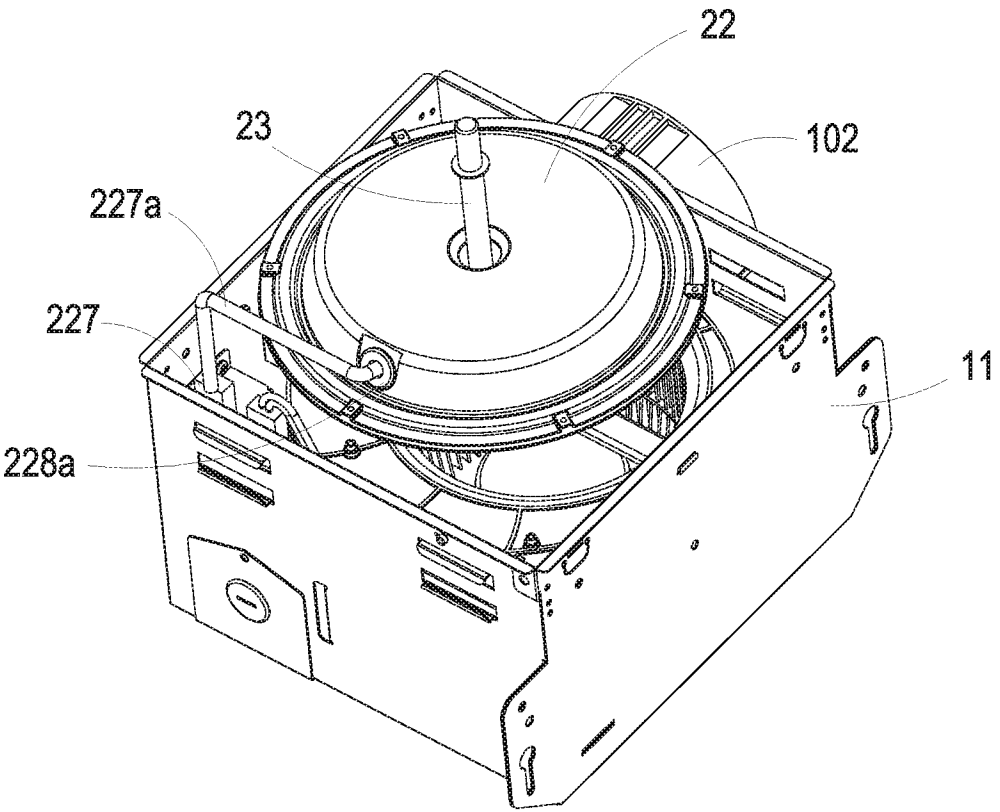
FIG. 7 is a perspective view illustrating a ventilating and illuminating apparatus without the lampshade.

FIG. 7 is a perspective view illustrating a ventilating and illuminating apparatus without the lampshade. As shown in FIGS. 6 and 7, the ventilating fan 10 includes a power socket 14 disposed on the housing 11. Correspondingly, the illuminating device 22 includes a power plug 227 passing through the inhaling opening 101 and detachably connected with the power socket 14 so as to provide a power for the illuminating device 20. Certainly, the present invention is not limited thereto.

Figure 8:
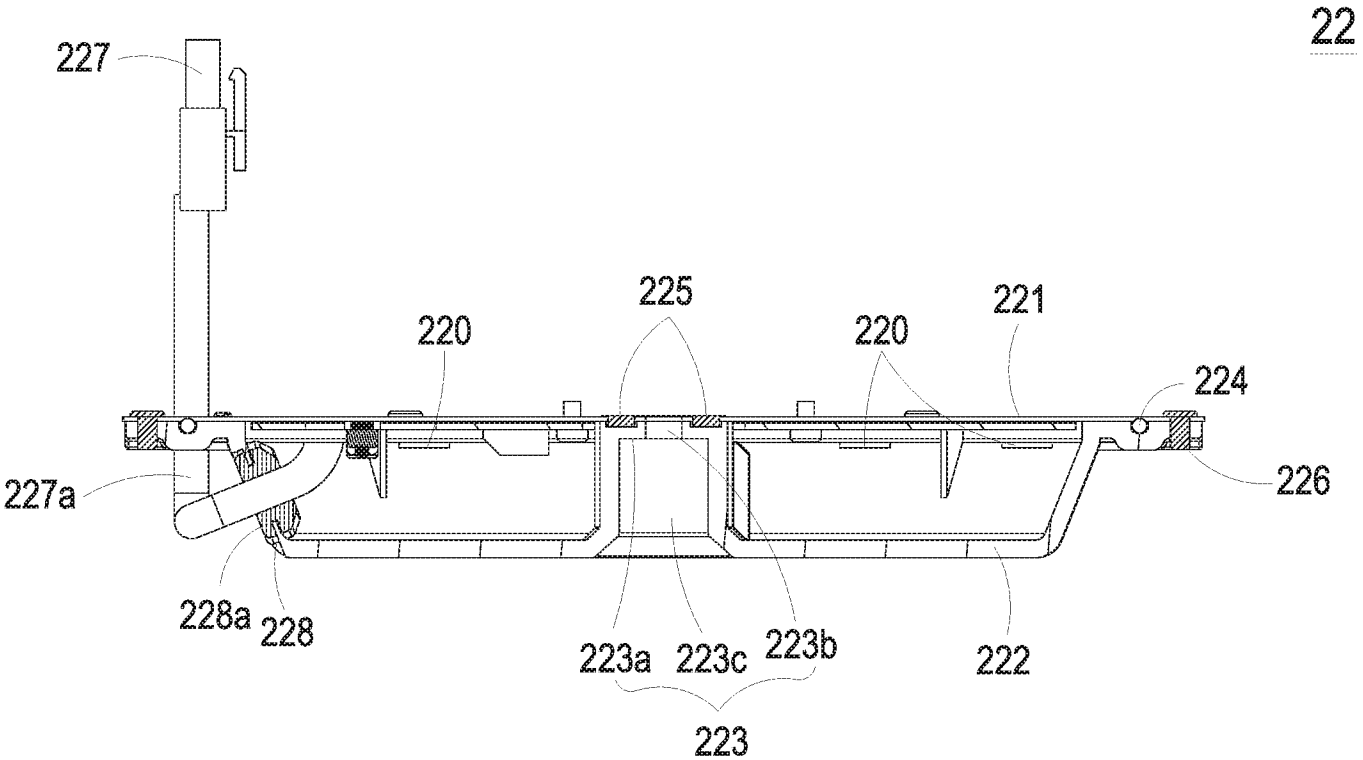
FIG. 8 is a sectional view illustrating the illuminating device of the present invention.

In the embodiment, the illuminating device 22 of the ventilating and illuminating apparatus 1 is detachable and can be a modular design. FIG. 8 is a sectional view illustrating the illuminating device of the present invention. The illuminating device 22 includes a substrate 221 having an illuminating element 220 and a first through hole 223*b* disposed thereon. Correspondingly, the illuminating device 22 includes a transparent case 222 disposed on the substrate 221 and having the resisting portion 223*a* and a second through hole 223*c*. It is noted that the first through hole 223*b* and the second through hole 223*c* are configured to form the through hole 223 of the illuminating device 223 while the transparent case 222 is fixed on the substrate 221. In the embodiment, the through hole 223 has the resisting portion 223*a* disposed therein and the cross section area of the resisting portion 223*a* is defined by the radius of the first through hole 223*b* and the second through hole 223*c*. Alternatively, the resisting portion 223*a* is formed by the difference of cross section between the second through hole 223*b* and the first through hole 223*b*. The first though hole 223*b* and the second through hole 223*b* can be but not limited to a circular hole. In some embodiments, the though hole 223 can provide a positioning alignment function by alternating varying the shape of the though hole 223. Certainly, the present invention is not limited thereto. It is not redundantly described herein.

In the embodiment, the substrate 221 and the transparent case 222 can be assembled by but not limited to a fastening screw 226. For packaging the illuminating element 220, the illuminating device 22 further includes an outer waterproof ring 224 and an inner waterproof ring 225. The outer waterproof ring 224 is disposed around the periphery of the substrate 221. The inner waterproof ring 225 is disposed on the substrate 221 and located around the first through hole 225. Furthermore, the outer waterproof ring 224 and the inner waterproof ring 225 are located between the substrate 221 and the transparent case 222 and configured to seal and isolate the illuminating element 220, so that the illuminating element 220 of the illuminating device 22 is protected from the influence of humidity caused by ventilating air.

Further referring to FIGS. 6, 7 and 8, the ventilating fan incudes a power socket 14 disposed on the housing 11 and the illuminating device 22 includes a power plug 227 passing through the inhaling opening 101 and detachably connected with the power socket 14 so as to provide a power for the illuminating device 22. The power plug 227 is connected to the substrate 221 by a conducting wire 227*a*. In the embodiment, preferably but not exclusively, the transparent case 222 includes a wiring hole 228 having a waterproof ring 228*a* disposed around the wiring hole 228, so as to receive the conducting wire 227*a* passing through and connected between the substrate 221 and the power plug 227. Consequently, the illuminating device 22 is waterproof and capable of avoiding from the influence of humidity caused by ventilating air.

In summary, the present provides a ventilating and illuminating apparatus. The illuminating device is attached to a ventilating fan via several modular parts for increasing the variations and facilitating to install and replace. Alternatively, the ventilating and illuminating apparatus includes a detachable illuminating device capable of maintenance and replacing easily, and further provides waterproof lighting for avoiding from the influence of humidity caused by ventilating air. Consequently, the ventilating and illuminating apparatus has the detachable illuminating device fastened by the means of clamping parts so as to reduce installation time and materials of the entire structure and facilitate to execute regular maintenance of detachable illuminating device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A ventilating and illuminating apparatus comprising:

a ventilating fan having a housing;

a connecting frame connected to the housing and having a mounting portion and a fastening hole, wherein the fastening hole is disposed on the mounting portion;

an illuminating device having an illuminating element and a through hole, wherein the illuminating device comprises a substrate having the illuminating element and a first through hole disposed thereon; and a transparent case disposed on the substrate and having a second through hole, wherein the first through hole and the second through hole are configured to form the through hole of the illuminating device while the transparent case is fixed on the substrate; and a connecting shaft partially passing through the through hole of the illuminating device and the fastening hole of the connecting frame and mounted on the mounting portion of the connecting frame, so as to fasten the illuminating device on the mounting portion of the connecting frame.

2. The ventilating and illuminating apparatus according to claim 1, further comprising a lampshade having a receiving space and a clamping hole.

3. The ventilating and illuminating apparatus according to claim 2, wherein the connecting shaft comprises:

a main portion;

a first end connected to the main portion and configured to pass through the through hole of the illuminating device and the fastening hole of the connecting frame;

a first fastening element disposed on the first end and configured to engage with the fastening hole of the connecting frame;

a second end connected to the main portion, opposite to the first end, and passing through the clamping hole of the lampshade; and a second fastening element disposed on the second end and configured to fasten the lampshade.

4. The ventilating and illuminating apparatus according to claim 3, wherein the first fastening element comprises:

a first screwing portion disposed on the first end and extended sequentially from the main portion to the first end; and a first clamping portion disposed between the first end and the main portion and extending outwardly from the outer circumferential surface of the main portion, so that the outer circumferential surface of the first clamping portion is larger than the outer circumferential surface of the main portion of the connecting shaft.

5. The ventilating and illuminating apparatus according to claim 4, wherein the illuminating device comprises a resisting portion disposed around the through hole and configured to push against the first clamping portion while the first screwing portion of the connecting shaft passes through the through hole of the connecting frame so as to clamp and fasten the illuminating device between the connecting frame and the connecting shaft.

6. The ventilating and illuminating apparatus according to the claim 3, further comprising a fixing element configured to engage with the second fastening element while the second end of the connecting shaft passes through the clamping hole of the lampshade, so that the lampshade is clamped and fastened on the connecting shaft and the illuminating device is accommodated in the receiving space of the lampshade.

7. The ventilating and illuminating apparatus according to claim 6, wherein the second fastening element comprises:

a second screwing portion disposed on the second end and extended sequentially from the main portion to the second end; and a second clamping portion disposed between the second end and the main portion and extending outwardly from the outer circumferential surface of the main portion, so that the outer circumferential surface of the second clamping portion is larger than the outer circumferential surface of the main portion of the connecting shaft.

8. The ventilating and illuminating apparatus according to claim 7, wherein the outer circumferential surface of the second clamping portion is larger than the size of the clamping hole of the lampshade, and the outer circumferential surface of the second screwing portion is smaller than the size of the clamping hole of the lampshade.

9. The ventilating and illuminating apparatus according to claim 7, wherein the fixing element comprises a clamping ring and an engaged part, wherein the lampshade is clamped between the second clamping portion of the connecting shaft and the clamping ring and the engaged part is engaged with the second screwing portion of the connecting shaft while the second screwing portion of the connecting shaft passes through the clamping hole of the lampshade so as to clamp and fasten the lampshade on the second end of the connecting shaft.

10. The ventilating and illuminating apparatus according to claim 1, wherein the housing comprises an inhaling opening and an exhausting opening, and the connecting frame is disposed nearby the inhaling opening.

11. The ventilating and illuminating apparatus according to claim 10 wherein the connecting frame comprises two fastening ends configured to fasten the connecting frame on the housing and the mounting portion of the connecting frame extends outwardly from the inhaling opening.

12. The ventilating and illuminating apparatus according to claim 11, wherein the housing comprises two fastened portions configured to connect with the two fastening ends respectively so as to fasten the connecting frame on the housing and have the connecting frame stretching across the inhaling opening of the housing.

13. The ventilating and illuminating apparatus according to claim 12, wherein the two fastening ends are respectively selected from one of a hook, a buckle, a clamp and a screw, and the two fastened portions are respectively selected from one of an engaged hole and a screw hole, so that the two fastening ends are engaged with the two fastened portions respectively and the connecting frame is fastened on the housing and stretching across the inhaling opening of the housing.

14. The ventilating and illuminating apparatus according to claim 1, wherein the illuminating device comprises:

an outer waterproof ring disposed around the periphery of the substrate; and an inner waterproof ring disposed around the first through hole, wherein the outer waterproof ring and the inner waterproof ring are located between the substrate and the transparent case and configured to seal and isolate the illuminating element.

15. The ventilating and illuminating apparatus according to claim 1, wherein the illuminating device comprises a fastening screw configured to fasten the transparent case onto the substrate.

16. The ventilating and illuminating apparatus according to claim 1, wherein the illuminating device comprises a power plug and the transparent case comprises a wiring hole having a waterproof ring disposed therearound, so as to receive a conducting wire passing through and connected between the substrate and the power plug.

17. The ventilating and illuminating apparatus according to claim 1, wherein the ventilating fan comprises a power socket disposed on the housing and the illuminating device comprises a power plug detachably connected with the power socket so as to provide a power for the illuminating device.

18. The ventilating and illuminating apparatus according 1, wherein the housing and the illuminating device are configured to form an air channel connected to the inhaling opening.

19. The ventilating and illuminating apparatus according to claim 1, wherein the ventilating fan is an embedded ventilating fan and the housing is fastened and embedded into an object.

* * * * *